US008692724B2

(12) United States Patent
Soekawa

(10) Patent No.: US 8,692,724 B2
(45) Date of Patent: Apr. 8, 2014

(54) COMMUNICATION APPARATUS

(75) Inventor: Kouji Soekawa, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 210 days.

(21) Appl. No.: 13/443,665

(22) Filed: Apr. 10, 2012

(65) Prior Publication Data

US 2012/0287010 A1 Nov. 15, 2012

(30) Foreign Application Priority Data

May 11, 2011 (JP) ..... 2011-106575

(51) Int. Cl.
*H01Q 1/24* (2006.01)

(52) U.S. Cl.
CPC ..... *H01Q 1/24* (2013.01)
USPC ..... 343/702; 343/848

(58) Field of Classification Search
CPC ..... H01Q 1/24
USPC ..... 343/702, 846, 848, 700 MS
See application file for complete search history.

(56) References Cited

U.S. PATENT DOCUMENTS

2004/0253972 A1* 12/2004 Iwai et al. ..... 455/550.1
2006/0109185 A1* 5/2006 Iwai et al. ..... 343/702
2007/0031091 A1* 2/2007 Mitamura et al. ..... 385/88
2009/0170570 A1* 7/2009 Uejima et al. ..... 455/575.3

FOREIGN PATENT DOCUMENTS

JP 2010-278921 A 12/2010

* cited by examiner

*Primary Examiner* — Hoanganh Le
(74) *Attorney, Agent, or Firm* — Maschoff Brennan

(57) ABSTRACT

A communication apparatus includes: a wiring group to couple wiring on a first board to wiring on a second board; antenna wiring including one end coupled to a feeding unit on the first board and the other end coupled to one end of a capacitor, the other end of the capacitor being coupled to a ground conductor of the second board; and ground conductor wiring for an antenna, disposed between the antenna wiring and the wiring group, including one end coupled to a ground conductor of the first board and the other end coupled to the ground conductor of the second board.

7 Claims, 7 Drawing Sheets

COMMUNICATION APPARATUS

CROSS-REFERENCE TO RELATED APPLICATION(S)

This application is based upon and claims the benefit of priority of the prior Japanese Patent Application No. 2011-106575, filed on May 11, 2011, the entire contents of which are incorporated herein by reference.

FIELD

The embodiments discussed herein are related to a communication apparatus which includes an antenna.

BACKGROUND

Communication apparatuses may have a function allowing viewing of broadcasts. For example, to view broadcasts by using a cellular phone or the like, an antenna having a certain length may be used. In a foldable cellular phone, a casing itself may be used as an antenna. A board included in the casing on the keyboard side, a board included in the casing on the display side, and a flexible board having wiring that couples these boards are used as a casing antenna. The flexible board may include signal wiring, ground wiring sets, and antenna wiring. The ground wiring sets may be disposed so as to sandwich signal lines, and may have a shield function.

The related art is disclosed in, for example, Japanese Laid-open Patent Publication No. 2010-278921.

SUMMARY

According to an aspect of the invention, communication apparatus includes: a wiring group to couple wiring on a first board to wiring on a second board; antenna wiring including one end coupled to a feeding unit on the first board and the other end coupled to one end of a capacitor, the other end of the capacitor being coupled to a ground conductor of the second board; and ground conductor wiring for an antenna, disposed between the antenna wiring and the wiring group, including one end coupled to a ground conductor of the first board and the other end coupled to the ground conductor of the second board.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

One end of antenna wiring in a flexible board is coupled to a feeding unit in a board included in the casing on the keyboard side, and the other end of the antenna wiring is coupled to one of the terminals of a capacitor in a board included in the casing on the display side. The other terminal of the capacitor is coupled to ground wiring for the board on the display side. The antenna wiring, the capacitor, and the ground wiring form an electrical loop. Accordingly, resonance occurs due to a component of the capacitor and an inductance component of the loop, and the ground wiring may produce resonance. When signal wiring that is used for high-speed serial transmission and that produces high-frequency noise is present, the ground wiring that produces resonance may amplify the high-frequency noise, resulting in degradation in receiver sensitivity.

Wiring for an antenna and a dummy pattern that is located outside signal wiring may be disposed along one of the edges of a flexible board used in a foldable cellular phone. The wiring for an antenna and the signal wiring are provided for the flexible board used in the foldable cellular phone. The wiring for an antenna is provided between the dummy pattern and the signal wiring. The dummy pattern may have a length equal to or smaller than a quarter of the wavelength of the usable frequency. The dummy pattern and the wiring for an antenna are coupled by multiple connection units. Accordingly, an influence on antenna characteristics which occurs when the antenna resonant frequency varies in the usable frequency band may decrease.

A communication apparatus includes a wiring group, which couples wiring on a first board, including signal wiring, power wiring, and ground wiring, to wiring on a second board, including signal wiring, power wiring, and ground wiring, antenna wiring, and ground conductor wiring for an antenna.

Figure 1:
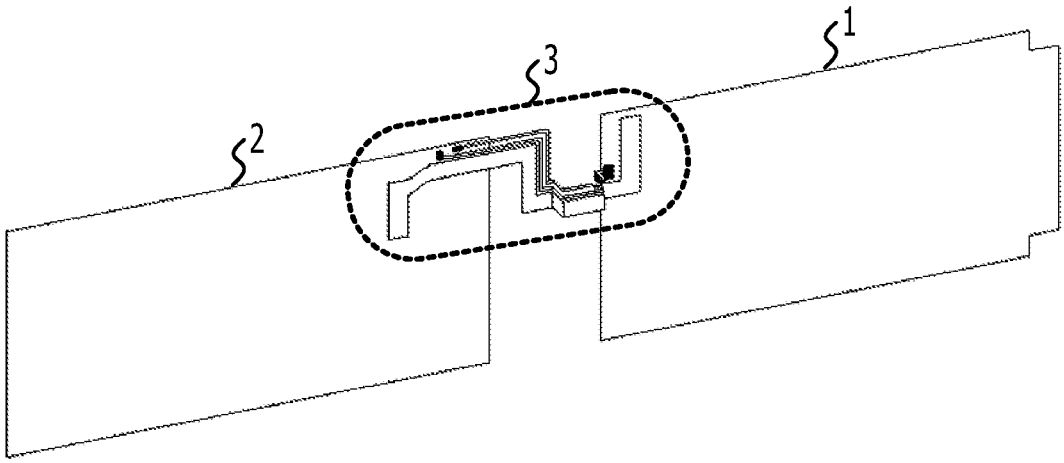
FIG. 1 illustrates an exemplary antenna.

FIG. 1 illustrates an exemplary antenna. The antenna illustrated in FIG. 1 may be, for example, a casing antenna used for a foldable cellular phone. The antenna illustrated in FIG. 1 may be used for, for example, communication equipment or electronic equipment.

A printed circuit board 1 illustrated in FIG. 1 may be included in a casing provided with a keyboard for a foldable cellular phone. A printed circuit board 2 may be included in a casing provided with a display for the foldable cellular phone. The printed circuit boards 1 and 2 may be, for example, hard printed circuit boards. Electronic components (not illustrated) for controlling the keyboard for the cellular phone may be implemented on the printed circuit board 1. Electronic components (not illustrated) for controlling the display for the cellular phone may be implemented on the printed circuit board 2. The printed circuit board 1 includes a feeding unit. Alternatively, the printed circuit board 2 may include the feeding unit.

Figure 2A:
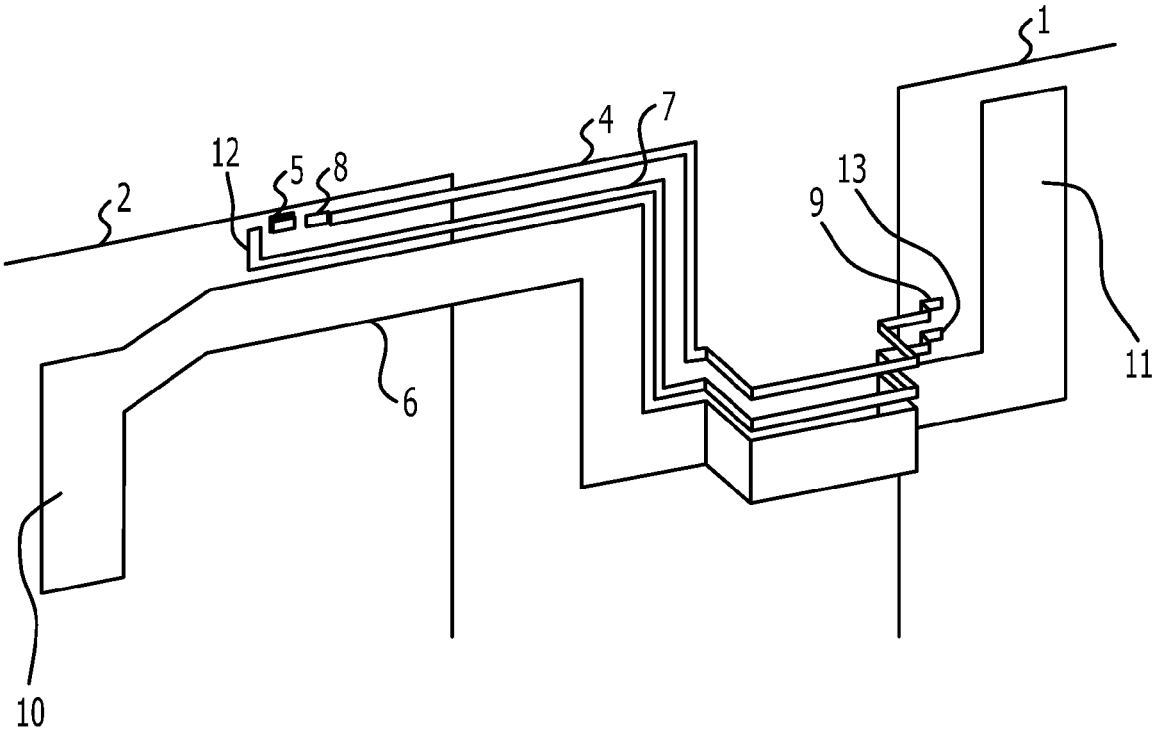
FIGS. 2A and 2B illustrate an exemplary connection unit.
Figure 2B:
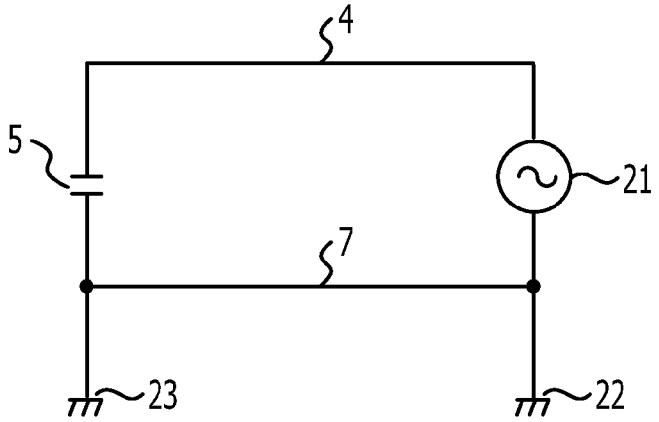

A connection unit 3 may be a wiring board that couples wiring on the printed circuit board 1 to wiring on the printed circuit board 2. FIGS. 2A and 2B illustrate an exemplary connection unit. Board wiring of the connection unit 3 illustrated in FIG. 2A includes antenna wiring 4, a wiring group 6 including signal wiring, power wiring, and ground wiring (ground conductor wiring), and ground conductor wiring for an antenna 7 (hereinafter, referred to as antenna ground conductor wiring 7). A flexible board, for example, may be used for the board wiring. The base member of the flexible board may include films including polyimide resin, and each of the wires used for the wiring may be a conductor such as copper foil. The base member may have multiple layers, and the signal wiring and the power wiring may be disposed in a layer different from a layer in which the ground wiring is disposed. The base member of the wiring board may not be illustrated in FIG. 2A for the sake of convenience.

FIG. 2B illustrates a relationship among a feeding unit 21, the antenna wiring 4, the antenna ground conductor wiring 7, and ground patterns (ground conductors) 22 and 23 of the respective printed circuit boards 1 and 2. A first end 9 of the antenna wiring 4 is coupled to one of the terminals of the feeding unit 21 on the printed circuit board 1 as illustrated in FIG. 2B, and a second end 8 of the antenna wiring 4 is coupled to one of the terminals of a capacitor 5. The other terminal of the capacitor 5 is coupled to the ground pattern (ground conductor) 23 of the printed circuit board 2. The ground pattern 23 may be disposed on the surface of the printed circuit board 2, or may be disposed inside the printed circuit board 2. A capacitance may be spatially coupled instead of the capacitor 5. The other terminal of the feeding unit 21 is coupled to the ground pattern (ground conductor) 22 of the printed circuit board 1. The ground pattern 22 may be disposed on the surface of the printed circuit board 1, or may be disposed inside the printed circuit board 1.

The feeding unit 21 is coupled to, for example, a transmitter/receiver of a radio circuit or a tuner circuit that is provided for the printed circuit board 1. The transmitter/receiver processes signals to be transmitted or received signals, and is supplied with power from, for example, a battery (not illustrated) incorporated in the communication apparatus or the like.

The power wiring may be wiring for supplying power from the printed circuit board 1 to the printed circuit board 2. The ground wiring is coupled to the ground pattern (ground conductor) 22 of the printed circuit board 1 and to the ground pattern 23 of the printed circuit board 2. The signal wiring may be, for example, wiring for transmitting control signals for the cellular phone or wiring for transmitting received signals, signals to be transmitted or the like. The signal wiring may be, for example, wiring for coupling signal wiring on the printed circuit board 1 to signal wiring on the printed circuit board 2. The wiring of the wiring group 6 may be coupled to the wiring on the printed circuit board 2 in a contact portion 10 provided in an end portion of the wiring group 6 illustrated in FIG. 2A. The wiring of the wiring group 6 may be coupled to the wiring on the printed circuit board 1 in a contact portion 11 provided in an end portion of the wiring group 6.

The antenna ground conductor wiring 7 is disposed between the antenna wiring 4 and the wiring group 6, and may have a length smaller than that of the ground conductor wiring of the wiring group 6. For example, as illustrated in FIG. 2B, a first end 13 of the antenna ground conductor wiring 7 may be coupled to the ground pattern 22 of the printed circuit board 1, and a second end 12 of the antenna ground conductor wiring 7 may be coupled to the ground pattern 23 of the printed circuit board 2.

In the casing antenna illustrated in FIG. 2A, the antenna ground conductor wiring 7 and the antenna wiring 4 form an electrical loop. Resonance occurs due to a component of the capacitor 5 and an inductance component of the loop. This resonance excites the printed circuit board 2, for example, a display board or the like, and the entire display board serves as an antenna. Furthermore, the printed circuit board 1, for example, a board for a keyboard or the like, may also serve as an antenna, and the entire casing may serve as a dipole antenna.

Figure 3A:
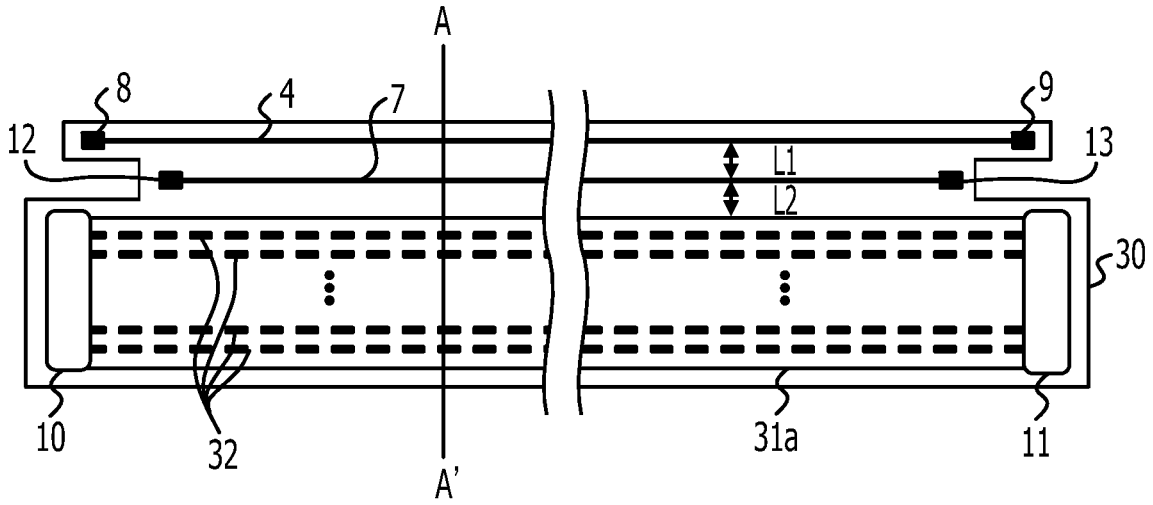
FIGS. 3A and 3B illustrate an exemplary board wiring.
Figure 3B:
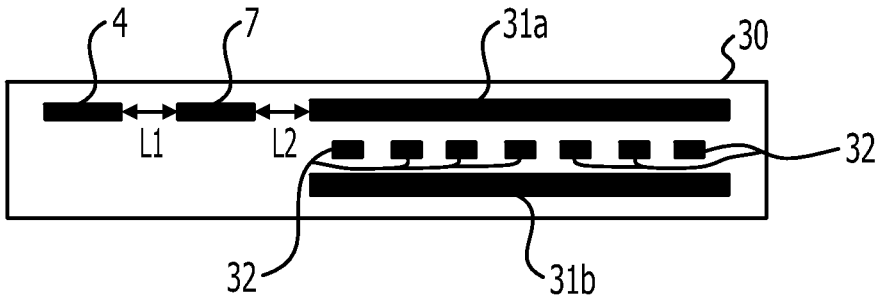

FIGS. 3A and 3B illustrate an exemplary board wiring. A flexible board 30 may include the antenna wiring 4, the antenna ground conductor wiring 7, and the wiring group 6 including wiring sets 32 and ground wiring 31*a* and 31*b*. The antenna wiring 4, the wiring sets 32 including the signal wiring and the power wiring, the ground wiring 31*a* and the ground wiring 31*b*, and the antenna ground conductor wiring 7 are disposed in the base member of the flexible board 30 illustrated in FIG. 3A. The antenna ground conductor wiring 7 is disposed between the antenna wiring 4 and the wiring group 6. In FIG. 3A, the ground wiring 31*a* is illustrated, but the ground wiring 31*b* may not be illustrated for the sake of convenience. The antenna ground conductor wiring 7 may have a length smaller than those of the ground wiring 31*a* and the ground wiring 31*b*. The wiring sets 32 including the signal wiring and the power wiring are disposed between the ground wiring 31*a* and the ground wiring 31*b*. Since the wiring sets 32 are disposed between the ground wiring 31*a* and the ground wiring 31*b* as illustrated in FIG. 3B, the wiring sets 32 are shielded by the ground wiring 31*a* and the ground wiring 31*b*. FIG. 3B is a cross-sectional view along line IIIB-IIIB of FIG. 3A. The wiring sets 32 may include ground wiring other than the ground wiring 31*a* and 31*b*.

The wiring pattern widths of the antenna wiring 4 and the antenna ground conductor wiring 7 may be 0.5 mm. A distance L1 between the antenna wiring 4 and the antenna ground conductor wiring 7 may be equal to or larger than 1.0 mm. A distance L2 between the antenna ground conductor wiring 7 and the ground wiring 31*a* or 31*b* may be equal to or larger than 0.5 mm. The widths or the distances may be such a width or a distance that high-frequency noise is reduced.

Figure 4A:
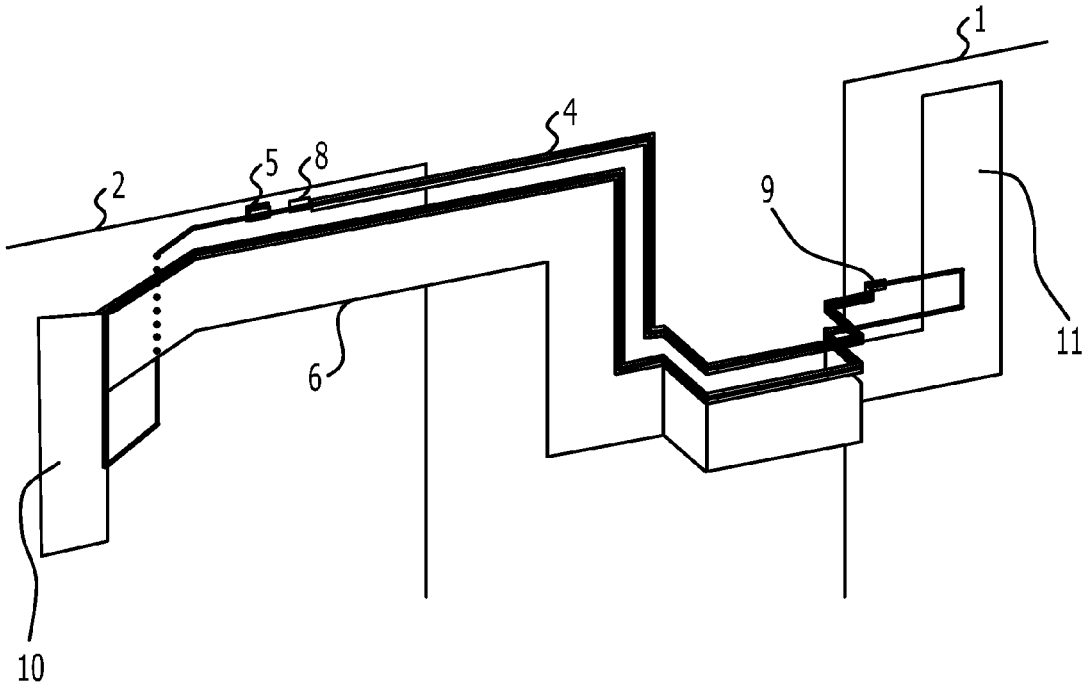
FIGS. 4A and 4B illustrate an exemplary current path.
Figure 4B:
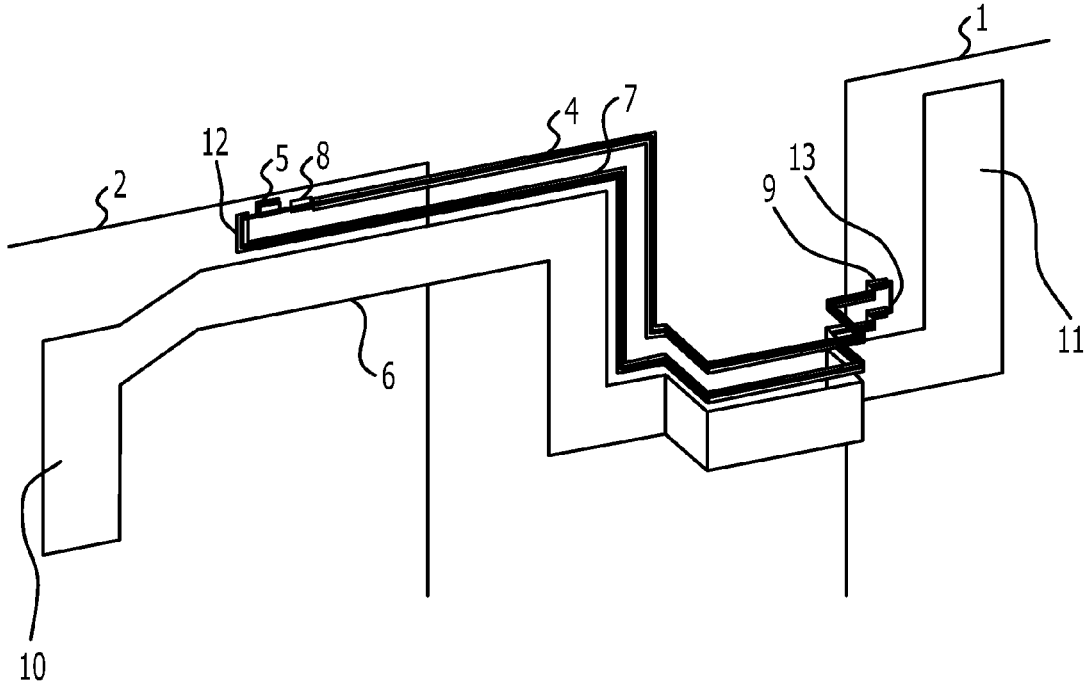
Figure 5A:
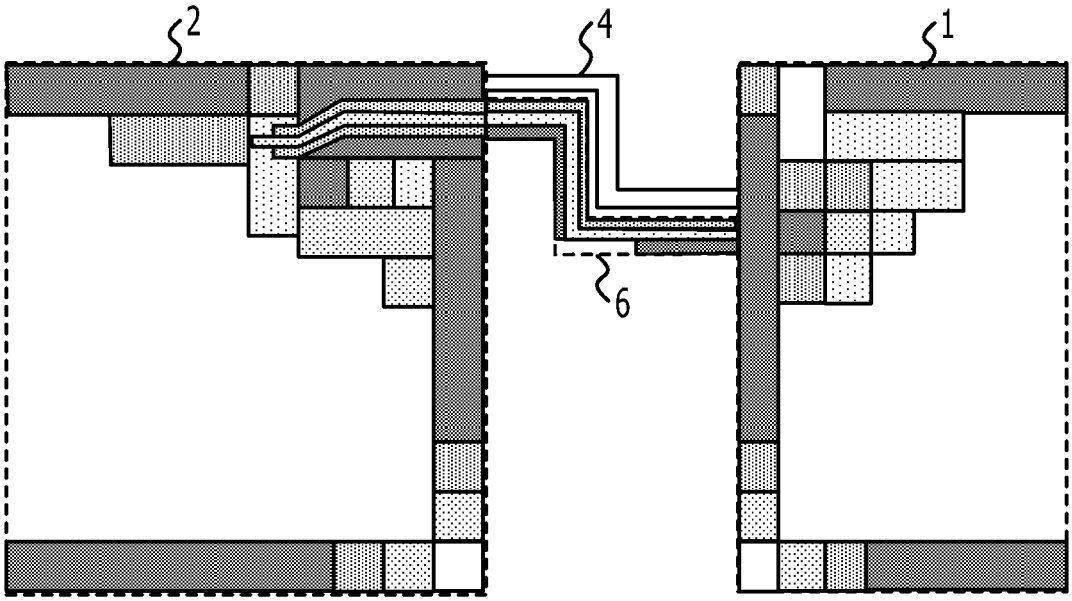
FIGS. 5A and 5B illustrate an exemplary current distribution.
Figure 5B:
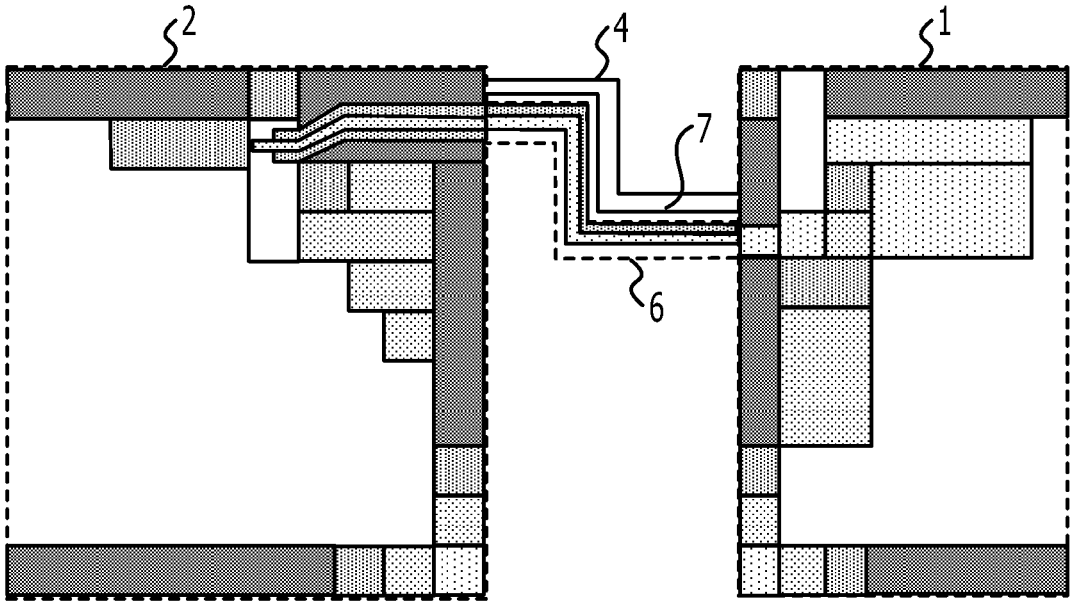

FIGS. 4A and 4B illustrate an exemplary current path. The antenna ground conductor wiring 7 is not disposed in FIG. 4A, whereas the antenna ground conductor wiring 7 is disposed in FIG. 4B. A thick line and a dotted line illustrated in FIGS. 4A and 4B represent a current. The base member of the wiring board may not be illustrated in FIGS. 4A and 4B for the sake of convenience. FIGS. 5A and 5B illustrate an exemplary current distribution. FIGS. 5A and 5B may illustrate a simulation result. The antenna ground conductor wiring 7 is not disposed in FIG. 5A, whereas the antenna ground conductor wiring 7 is disposed in FIG. 5B. In FIGS. 5A and 5B, a darker portion or a denser pattern portion in the current distribution indicates a larger amount of current, and a lighter portion or a sparser pattern portion in the current distribution indicates a smaller amount of current.

When the antenna ground conductor wiring 7 is not disposed as illustrated in FIG. 4A, the ground wiring of the wiring group 6 and the antenna wiring 4 in the wiring board form an electrical loop. Resonance occurs due to a component of the capacitor 5 and an inductance component of the loop. This resonance excites the printed circuit board 2, for example, the display board, and the entire display board serves as an antenna. Furthermore, the printed circuit board 1, for example, the board for the keyboard, may also serve as an antenna, and the entire casing may serve as a dipole antenna.

In the casing antenna as illustrated in FIG. 4A, the ground wiring 31*a* and the ground wiring 31*b* which are disposed so as to sandwich the signal wiring of the wiring group 6 may produce resonance. When the signal wiring of the wiring group 6 includes signal wiring that is used for high-speed serial transmission and that produces high-frequency noise, the ground wiring 31*a* and the ground wiring 31*b* of the wiring group 6 that produce resonance may not shield the wiring sets 32, resulting in amplification of high-frequency noise. Due to the influence of the amplified high-frequency noise, the receiver sensitivity for, for example, the communication apparatus or the electronic equipment may become degraded. The receiver sensitivity may include receiver sensitivity for, for example, a tuner installed in the communication apparatus.

As illustrated in FIG. 5A, when current is supplied from the feeding unit, current may be higher in a region closer to the antenna wiring 4 in the current distribution for the wiring group 6. The high-frequency noise may have an influence on signals in the signal wiring.

In the casing antenna as illustrated in FIG. 4B, the resonance produced by the ground wiring 31*a* and the ground wiring 31*b* which are disposed so as to sandwich the signal wiring of the wiring group 6 reduces, and the antenna ground conductor wiring 7 produces resonance. One end of the antenna ground conductor wiring 7 is coupled to the ground pattern near the feeding unit, and the other end is coupled to the vicinity of the capacitor 5. For example, a loop including the antenna wiring 4 and the antenna ground conductor wiring 7 may be formed inside the loop including the antenna wiring 4 and the ground wiring of the wiring group 6 illustrated in FIG. 4A.

Since current flows along the shortest route, current may flow along the loop including the antenna wiring 4 and the antenna ground conductor wiring 7, rather than along the loop including the antenna wiring 4 and the ground wiring of the wiring group 6. Accordingly, the antenna ground conductor wiring 7 of the casing antenna may mainly produce resonance, and the amplification of the high-frequency noise of the signal wiring, which is interposed between the ground wiring 31*a* and the ground wiring 31*b* of the wiring group 6, due to the resonance may be reduced, resulting in an excellent receiver sensitivity characteristic.

As illustrated in FIG. 5B, when current is supplied from the feeding unit, current may concentrate in the antenna wiring 4 and the antenna ground conductor wiring 7 in the current distribution for the wiring group 6. The high-frequency noise may have an influence on signals in the signal wiring. The antenna wiring 4 and the antenna ground conductor wiring 7 where the current concentrates may produce resonance. The concentration of the current in the wiring group 6 as illustrated in FIG. 5A may be reduced.

Since the signal wiring that causes a large amount of high-frequency noise is located apart from the antenna ground conductor wiring 7, the receiver sensitivity may increase. For example, since current is higher in a region closer to the antenna ground conductor wiring 7, the signal wiring disposed apart from the antenna ground conductor wiring 7 may cause the high-frequency noise to decrease.

The flexible board may have a shape other than those illustrated in FIGS. 1, 2A, 3A, 3B, and 4B. The communication apparatus may include a first flexible board including the antenna wiring 4 and the antenna ground conductor wiring 7, and a second flexible board including the wiring group 6.

Figure 6A:
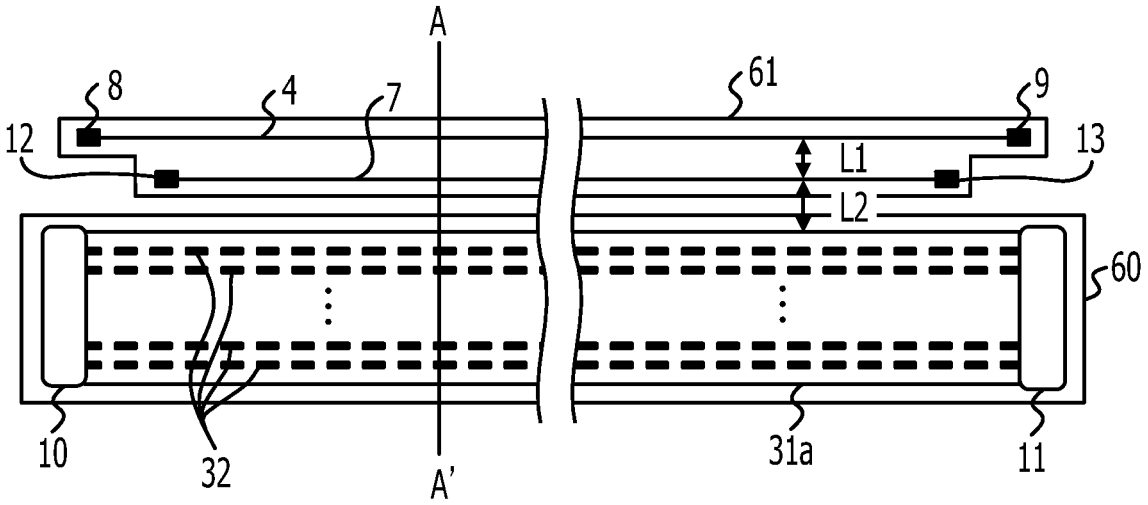
FIGS. 6A and 6B illustrate an exemplary board wiring.
Figure 6B:
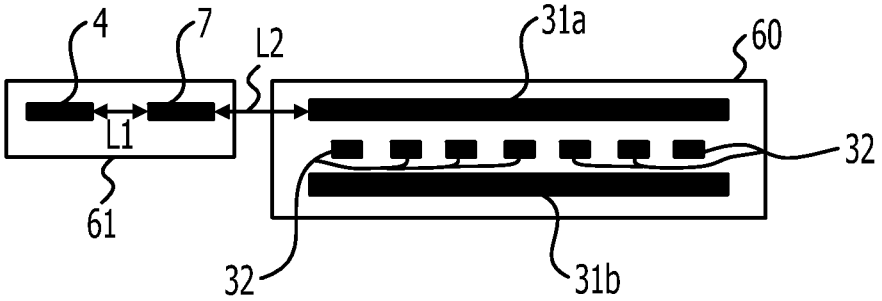

FIGS. 6A and 6B illustrate an exemplary board wiring. In the base member of a flexible board 60 illustrated in FIG. 6A, the wiring sets 32 including the signal wiring and the power wiring, and the ground wiring 31*a* and the ground wiring 31*b* are disposed. In the base member of a flexible board 61, the antenna wiring 4 and the antenna ground conductor wiring 7 are disposed. The antenna ground conductor wiring 7 in the flexible board 61 is disposed between the antenna wiring 4 in the flexible board 61 and the wiring group 6 in the flexible board 60. In FIG. 6A, the ground wiring 31*a* is illustrated, but the ground wiring 31*b* may not be illustrated for the sake of convenience. The antenna ground conductor wiring 7 may have a length smaller than those of the ground wiring 31*a* and the ground wiring 31*b*. The wiring sets 32 including the signal wiring and the power wiring are disposed between the ground wiring 31*a* and the ground wiring 31*b*. Since the wiring sets 32 are disposed between the ground wiring 31*a* and the ground wiring 31*b* as illustrated in FIG. 6B, the ground wiring 31*a* and the ground wiring 31*b* may shield the wiring sets 32. FIG. 6B is a cross-sectional view along line VIB-VIB of FIG. 6A. The wiring sets 32 may include ground wiring other than the ground wiring 31*a* and 31*b*.

The wiring pattern widths of the antenna wiring 4 and the antenna ground conductor wiring 7 may be 0.5 mm. A distance L1 between the antenna wiring 4 and the antenna ground conductor wiring 7 may be equal to or larger than 1.0 mm. A distance L2 between the antenna ground conductor wiring 7 and the ground wiring 31*a* or 31*b* may be equal to or larger than 0.5 mm. The widths or the distances may be such a width or a distance that high-frequency noise is reduced.

The resonance produced by the ground wiring 31*a* and the ground wiring 31*b* which are disposed so as to sandwich the signal wiring of the wiring group 6 may decrease, and the antenna ground conductor wiring 7 may produce resonance. One end of the antenna ground conductor wiring 7 may be coupled to the ground pattern near the feeding unit, and the other end may be coupled to the vicinity of the capacitor 5.

Since current flows along the shortest route, current may flow along a loop including the antenna wiring 4 and the antenna ground conductor wiring 7. The antenna ground conductor wiring 7 of the casing antenna may mainly produce resonance, and the amplification of the high-frequency noise of the signal wiring, which is interposed between the ground wiring 31*a* and the ground wiring 31*b* of the wiring group 6, due to the resonance may be reduced, resulting in an excellent receiver sensitivity characteristic.

Since the signal wiring having high-frequency noise is located apart from the antenna ground conductor wiring 7, the receiver sensitivity may increase. For example, since current is higher in a region closer to the antenna ground conductor wiring 7, the signal wiring disposed apart from the antenna ground conductor wiring 7 may cause the high-frequency noise to decrease. The flexible board may have a shape other than those illustrated in FIGS. 6A and 6B.

The communication apparatus includes a flexible board including the antenna wiring, antenna ground conductor wiring sets, and the wiring group. An antenna ground conductor wiring set corresponding to a first layer and an antenna ground conductor wiring set corresponding to a second layer are disposed. At least one signal wiring set of the wiring group is disposed in a third layer between the first layer and the second layer. The signal wiring set is disposed between the two antenna ground conductor wiring sets.

Figure 7A:
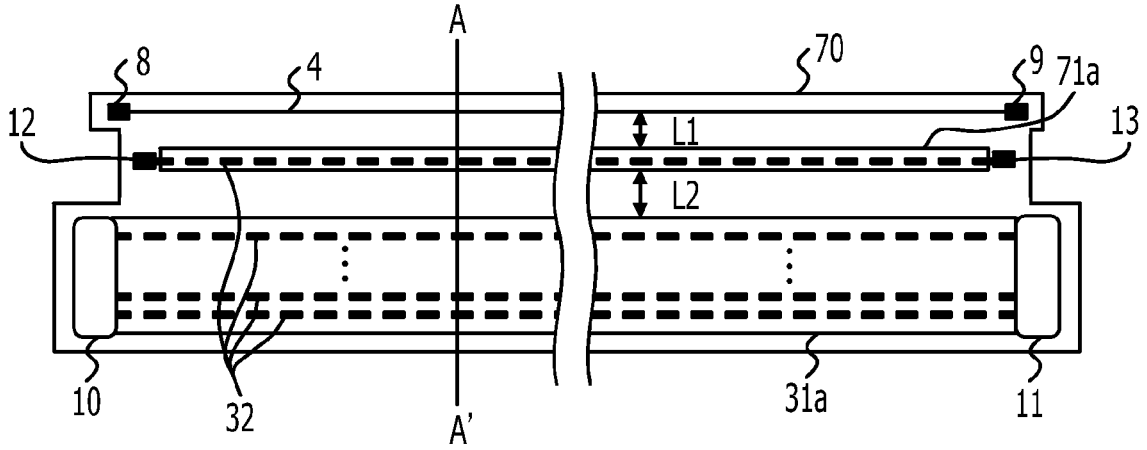
FIGS. 7A and 7B illustrate an exemplary board wiring.
Figure 7B:
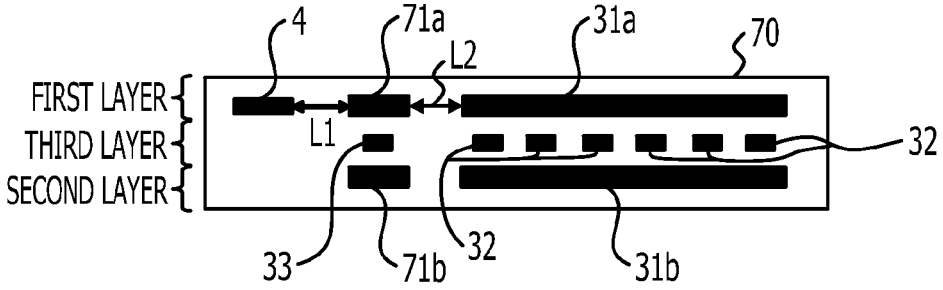

FIGS. 7A and 7B illustrate an exemplary board wiring. In the base member of a flexible board 70 illustrated in FIG. 7A, the antenna wiring 4, the wiring sets 32 including the signal wiring and the power wiring, the ground wiring 31*a* and the ground wiring 31*b*, antenna ground conductor wiring 71*a* and antenna ground conductor wiring 71*b*, and signal wiring 33 are disposed. The antenna ground conductor wiring 71*a* and the antenna ground conductor wiring 71*b* are disposed between the antenna wiring 4 in the flexible board 70 and the wiring group 6 in the flexible board 70. In FIG. 7A, the ground wiring 31*a* and the antenna ground conductor wiring 71*a* are illustrated, but the ground wiring 31*b* and the antenna ground conductor wiring 71*b* may not be illustrated for the sake of convenience. The antenna ground conductor wiring 71*a* and the antenna ground conductor wiring 71*b* may each have a length smaller than those of the ground wiring 31*a* and the ground wiring 31*b*.

The wiring sets 32 including the signal wiring and the power wiring are disposed between the ground wiring 31*a* and the ground wiring 31*b*. Since the wiring sets 32 are interposed between the ground wiring 31*a* and the ground wiring 31*b* as illustrated in FIG. 7B, the wiring sets 32 are shielded by the ground wiring 31*a* and the ground wiring 31*b*.

The signal wiring 33 that is unlikely to produce high-frequency noise is disposed between the antenna ground conductor wiring 71*a* and the antenna ground conductor wiring 71*b*. The signal wiring 33 may include a wire or more. FIG. 7B is a cross-sectional view along line VIIB-VIIB of FIG. 7A.

The wiring pattern widths of the antenna wiring 4 and the antenna ground conductor wiring 71*a* and 71*b* may be 0.5 mm. A distance L1 between the antenna wiring 4 and the antenna ground conductor wiring 71*a* or 71*b* may be equal to or larger than 1.0 mm. A distance L2 between the antenna ground conductor wiring 71*a* or 71*b* and the ground wiring 31*a* or 31*b* may be equal to or larger than 0.5 mm. The widths or the distances may be such a width or a distance that high-frequency noise is reduced. The flexible board may have a shape other than those illustrated in FIGS. 7A and 7B.

The resonance produced by the ground wiring 31*a* and 31*b* which are disposed so as to sandwich the signal wiring of the wiring sets 32 may decrease, and the antenna ground conductor wiring 71*a* and 71*b* may produce resonance. One end of each of the antenna ground conductor wiring 71*a* and the antenna ground conductor wiring 71*b* may be coupled to the ground pattern near the feeding unit, and the other end may be coupled to the vicinity of the capacitor 5.

Since current flows along the shortest route, current may flow along a loop including the antenna wiring 4 and the antenna ground conductor wiring 71*a* and 71*b*. The antenna ground conductor wiring 71*a* and 71*b* of the casing antenna may mainly produce resonance, and the amplification of the high-frequency noise of the signal wiring, which is interposed between the ground wiring 31*a* and the ground wiring 31*b* of the wiring group 6, due to the resonance may be reduced, resulting in an excellent receiver sensitivity characteristic.

Since the signal wiring having high-frequency noise is located apart from the antenna ground conductor wiring 71*a* and 71*b*, the receiver sensitivity may increase. For example, since current is higher in a region closer to the antenna ground conductor wiring 71*a* and 71*b*, the signal wiring disposed apart from the antenna ground conductor wiring 71*a* and 71*b* may cause the high-frequency noise to decrease.

The flexible board may have any shape.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A communication apparatus comprising:

a wiring group to couple wiring on a first board to wiring on a second board;

antenna wiring including one end coupled to a feeding unit on the first board and the other end coupled to one end of a capacitor, the other end of the capacitor being coupled to a ground conductor of the second board; and ground conductor wiring for an antenna, disposed between the antenna wiring and the wiring group, including one end coupled to a ground conductor of the first board and the other end coupled to the ground conductor of the second board.

2. The communication apparatus according to claim 1, wherein the ground conductor wiring for an antenna has a length smaller than a length of ground conductor wiring of the wiring group.

3. The communication apparatus according to claim 1, further comprising, a flexible board including the antenna wiring, the ground conductor wiring for an antenna, and the wiring group.

4. The communication apparatus according to claim 1, further comprising, a first flexible board including the antenna wiring and the ground conductor wiring for an antenna; and a second flexible board including the wiring group.

5. The communication apparatus according to claim 1, further comprising, a flexible board including a first layer, a second layer, and a third layer disposed between the first layer and the second layer, wherein the first layer and the second layer include the ground conductor wiring for an antenna, and wherein the third layer includes at least one signal wiring of the wiring group.

6. The communication apparatus according to claim 1, wherein a width of the antenna wiring is substantially the same as a width of the ground conductor wiring for an antenna.

7. The communication apparatus according to claim 1, wherein the antenna wiring and the ground conductor wiring for an antenna are disposed a first distance apart from each other, and wherein the ground conductor wiring for an antenna and the wiring group are disposed a second distance apart from each other.

* * * * *